US011383811B2

(12) United States Patent
Ideskog

(10) Patent No.: US 11,383,811 B2
(45) Date of Patent: Jul. 12, 2022

(54) METHOD FOR CONTROLLING THE PROPULSION OF A SHIP

(71) Applicant: Lean Marine Sweden AB, Gothenburg (SE)

(72) Inventor: Linus Ideskog, Öckerö (SE)

(73) Assignee: Lean Marine Sweden AB

( * ) Notice: Subject to any disclaimer, the term of this patent is extended or adjusted under 35 U.S.C. 154(b) by 240 days.

(21) Appl. No.: 16/630,953

(22) PCT Filed: Jul. 5, 2018

(86) PCT No.: PCT/EP2018/068248
§ 371 (c)(1),
(2) Date: Jan. 14, 2020

(87) PCT Pub. No.: WO2019/011779
PCT Pub. Date: Jan. 17, 2019

(65) Prior Publication Data

US 2020/0223522 A1 Jul. 16, 2020

(30) Foreign Application Priority Data

Jul. 14, 2017 (SE) ..... 1750935-7

(51) Int. Cl.
*B63H 3/10* (2006.01)
*B63H 21/21* (2006.01)
*B63B 79/40* (2020.01)

(52) U.S. Cl.
CPC ..... *B63H 21/21* (2013.01); *B63B 79/40* (2020.01); *B63H 3/10* (2013.01); *B63H 2021/216* (2013.01)

(58) Field of Classification Search
CPC .... B63H 21/21; B63H 3/10; B63H 2021/216; B63H 21/22; B63H 21/38; B63H 21/14;
(Continued)

(56) References Cited

U.S. PATENT DOCUMENTS 4,286,324 A * 8/1981 Ingram ..... F02C 9/56 60/39.282
4,896,642 A 1/1990 Washino et al.
(Continued)

FOREIGN PATENT DOCUMENTS

CN 101365613 A 2/2009
CN 102458979 A 5/2012
(Continued)

OTHER PUBLICATIONS

Shi et al., Simulation and Optimal Control of Diesel Engine Propulsion System, 2009, IEEE, p. 87-91 (Year: 2009).*
(Continued)

*Primary Examiner* — Mcdieunel Marc
(74) *Attorney, Agent, or Firm* — Lerner, David, Littenberg, Krumholz & Mentlik, LLP

(57) ABSTRACT

The present disclosure relates to a method for controlling the propulsion of a ship (10). The ship (10) comprises an engine (5) and a controllable pitch propeller (7), wherein torque and engine speed are adjusted to correspond to an output set point value. The adjustment is such that the ship (10) is operated in an operating condition with an engine speed of the engine (5) and a propeller pitch of the controllable pitch propeller (7) such that the fuel consumption of the ship (10) is brought and/or held within a desired fuel consumption range. The method comprises determining a top pressure value indicative of a top pressure in at least one cylinder (9) and reducing the torque of the engine (5) upon detection that the lop pressure value exceeds a top pressure threshold value.

9 Claims, 4 Drawing Sheets

(58) Field of Classification Search
CPC ..... F02D 29/02; F02D 41/1463; F02D 2200/701; F02D 35/023; F02D 31/001; B63B 79/40; B63B 79/10
See application file for complete search history.

(56) References Cited

U.S. PATENT DOCUMENTS

| | | | | |
|---|---|---|---|---|
| 6,379,114 | B1 * | 4/2002 | Schott | B63H 3/10 416/1 |
| 7,784,281 | B2 * | 8/2010 | Kotou | F02D 41/0097 60/700 |
| 10,378,461 | B2 * | 8/2019 | Hagiwara | F02D 19/061 |
| 2009/0030595 | A1 | 1/2009 | Sugai | |
| 2010/0274420 | A1 | 10/2010 | Veit et al. | |
| 2012/0129411 | A1 * | 5/2012 | Kodera | B60L 50/16 440/3 |
| 2014/0020375 | A1 | 1/2014 | Fujishima et al. | |
| 2016/0047323 | A1 | 2/2016 | Suzuki | |
| 2018/0050782 | A1 * | 2/2018 | Danielsson | F02D 29/02 |
| 2018/0148034 | A1 * | 5/2018 | Ideskog | B60W 10/04 |
| 2018/0298840 | A1 * | 10/2018 | Hagiwara | F02B 69/04 |
| 2018/0306125 | A1 * | 10/2018 | Renold-Smith | F02C 9/46 |
| 2018/0327068 | A1 * | 11/2018 | Peters | B63H 3/10 |

FOREIGN PATENT DOCUMENTS

| | | | |
|---|---|---|---|
| DE | DD156853 | A1 | 9/1982 |
| EP | 0048587 | A1 | 3/1982 |
| EP | 2813693 | A2 | 12/2014 |
| EP | 2993322 | A1 | 3/2016 |
| JP | S51143289 | A | 12/1976 |
| JP | H05322707 | A | 12/1993 |
| JP | 20122117 | A | 1/2012 |
| JP | 2016200037 | A | 12/2016 |
| WO | 2016169991 | A1 | 10/2016 |
| WO | 2017084773 | A1 | 5/2017 |

OTHER PUBLICATIONS

Veneri et al., Overview of electric propulsion and generation architectures for naval applications, 2012, IEEE, p. 1-6 (Year: 2012).*

International Search Report for PCT/EP2018/068248 dated Sep. 26, 2018, 4 pages.

Kazuyuki Maeda et al, "Reduction Methods of Nox Emission from Ships", Feb. 24, 1995, pp. 8-15, Retrieved from the Internet: URL: http://archive.jime.jp/e/publication/bulletin/english/pdf/mv26n011998p8.pdf (retrived on Sep. 18, 2018).

Swedish Search Report for Application No. 1750935-7 dated Mar. 6, 2018, 2 pages.

Thielen C. et al., "Minderung der Stickoxid-Emissionen auf Schiffen", Schiff und Hafen, 2008, vol. 60, No. 4, pp. 46-52.

Chinese Search Report for Application No. 201880046516.6, dated May 27, 2021, 2 pages.

* cited by examiner

METHOD FOR CONTROLLING THE PROPULSION OF A SHIP

CROSS-REFERENCE TO RELATED APPLICATIONS

The present application is a national phase entry under 35 U.S.C. § 371 of International Application No. PCT/EP2018/068248, filed Jul. 5, 2018, which claims priority from Swedish Patent Application No. 1750935-7, filed Jul. 14, 2017, the disclosures of which are incorporated by reference herein.

TECHNICAL FIELD

The present invention relates to a method for controlling the propulsion of a ship. Moreover, the present invention relates to a computer program, a computer readable medium, a control unit and a ship.

BACKGROUND

A controllable pitch ship propeller is designed such that the angle of attack of the blade can be continuously varied. In this manner, the torque of the main engine may be varied. A controllable pitch propeller is common for medium sized ships (50-150 m l.b.p.) with medium to high requirements on maneuverability.

Although a ship with a controllable pitch propeller can be maneuvered with an appropriated flexibility, contemporary ships often consume more fuel than necessary, for instance due to inappropriate operation settings of the ship's engine or the controllable pitch propeller.

SUMMARY

In view of the above, according to a first aspect of the present invention, an object of the present invention is to provide a method for controlling the propulsion of a ship wherein the engine of the ship is operated in appropriate operating conditions.

The above aspect is obtained by a method according to claim 1.

As such, the first aspect of the present invention relates to a method for controlling the propulsion of a ship. The ship comprises an engine and a controllable pitch propeller, wherein torque and engine speed are adjusted to correspond to an output set point value. The adjustment is such that the ship is operated in an operating condition with an engine speed of the engine and a propeller pitch of the controllable pitch propeller such that the fuel consumption of the ship is brought and/or held within a desired fuel consumption range.

According to the first aspect of the present invention, the method comprises:

- determining a NO value indicative of a NO content in the exhaust gas produced by the engine and
- reducing the torque of the engine upon detection that the $NO_x$ value exceeds a $NO_x$ threshold value.

As such, by virtue of the above method, a control of the propulsion of a ship is proposed wherein the engine is operated with an appropriate fuel consumption and wherein the $NO_x$ content also can be kept appropriately low. Thus, the above method implies an operating condition of the ship which is less harmful to the environment as compared to previously used operating conditions. Moreover, keeping the fuel consumption within the desired fuel consumption range implies cost reductions.

As used herein the term "$NO_x$ content" relates to the total content of nitrogen monoxide NO and nitrogen dioxide $NO_2$. It should however be noted that this term is also intended to mean the content of nitrogen monoxide or nitrogen dioxide if measured separately.

By virtue of the above method, an actual $NO_x$ content in the exhaust gas produced by the engine may be taken into account when controlling the propulsion of the ship. Thus, instead of determining constraints on e.g. the torque from simulations and/or tests in a test environment in order to avoid high $NO_x$ content levels when operating the ship's engine, the above method implies that the actual $NO_x$ content may be taken into account. Purely by way of example, the amount of $NO_x$ produced by the engine of a ship may vary throughout the life of the engine, for instance due to aging and/or wear, and such variations may be automatically accounted for in the above method.

Optionally, the ship comprises an exhaust gas system adapted to guide exhaust gases from the engine, the exhaust gas system comprising a $NO_x$ reduction assembly.

Optionally, the method comprises determining the $NO_x$ value by evaluating exhaust gas between, as seen in an intended direction of exhaust gas flow, the engine and the $NO_x$ reduction assembly in the exhaust gas system. Measuring the $NO_x$ content between the engine and the $NO_x$ reduction assembly implies that the $NO_x$ content measured is the $NO_x$ content in the exhaust gases produced by the engine. As such, the above method implies a rapid and stable control of the engine since the control is for instance not dependent on any changes of the capacity, for instance due to aging, of the $NO_x$ reduction assembly.

Optionally, the method comprises determining the NO value by evaluating exhaust gas downstream, as seen in an intended direction of exhaust gas flow, of the $NO_x$ reduction assembly in the exhaust gas system. Measuring the $NO_x$ content downstream of the $NO_x$ reduction assembly implies that the $NO_x$ content measured is the $NO_x$ content in the exhaust gas that will enter the environment ambient of the ship. As such, the above method implies that the engine can be controlled such that the $NO_x$ content does not exceed predetermined emission levels which for instance may be legal emission levels.

Optionally, the method comprises determining a geographical location of the ship and determining the $NO_x$ threshold value on the basis of the thus determined geographical location. Different geographical areas of the world may be associated with different allowable emission levels. As such, the above method, being adapted to adjust the $NO_x$ threshold value in dependence on the determined geographical location, implies that such different allowable emission levels may be taken into account when setting the $NO_x$ threshold value. This in turn implies an appropriate operation of the engine with appropriate $NO_x$ emission levels as well as an appropriate fuel consumption.

Optionally, the engine speed of the engine is increased upon detection that the $NO_x$ value exceeds the $NO_x$ threshold value. The speed increase implies that the ship may produce the requisite power, as indicated by the output set point value, whilst still producing exhaust gases with a $NO_x$ content lower than or equal to the $NO_x$ threshold value.

A second aspect of the present invention relates to a method for controlling the propulsion of a ship. The ship comprises an engine and a controllable pitch propeller. The engine comprises least one cylinder. The torque and engine speed are adjusted to correspond to an output set point value, wherein the adjustment is such that the ship is operated in an operating condition with an engine speed of the engine and a propeller pitch of the controllable pitch propeller such that the fuel consumption of the ship is brought and/or held within a desired fuel consumption range.

According to the second aspect of the present invention, the method comprises:

determining a top pressure value indicative of a top pressure in the at least one cylinder and reducing the torque of the engine upon detection that the top pressure value exceeds a top pressure threshold value.

Excessive top pressures may be harmful to the engine. As such, by virtue of the above method according to the second aspect of the present invention, the risk of damaging the engine may be kept appropriately low.

Optionally, the engine speed of the engine is increased upon detection that the top pressure value exceeds the top pressure threshold value.

Optionally, for the first and/or second aspects of the present invention, the feature of reducing the torque of the engine comprises reducing the propeller pitch of the controllable pitch propeller.

A third aspect of the present invention relates to a computer program comprising program code means for performing the steps of any one of the first or second aspects of the present invention when the program is run on a computer.

A fourth aspect of the present invention relates to a computer readable medium carrying a computer program comprising program code means for performing the steps of any one of the first or second aspects of the present invention when the program product is run on a computer.

A fifth aspect of the present invention relates to a control unit for controlling the propulsion of a ship. The ship comprises an engine and a controllable pitch propeller, wherein the control unit is adapted to receive a signal indicative of an output set point value. The control unit is also adapted to issue control signals to control the engine speed of the engine and the propeller pitch of the controllable pitch propeller in response to the output set point value. The control signals are determined such that the ship is operated in an operating condition, corresponding to the output set point value, with an engine speed of the engine and a propeller pitch of the controllable pitch propeller such that the fuel consumption of the ship is brought and/or held within a desired fuel consumption range.

According to the fifth aspect of the present invention, the control unit is adapted to:

receive a $NO_x$ signal with a $NO_x$ value indicative of a $NO_x$ content in exhaust gas produced by the engine and to issue a control signal to reduce the torque of the engine upon detection that the $NO_x$ value exceeds a $NO_x$ threshold value.

Optionally, the ship comprises an exhaust gas system adapted to guide exhaust gas from the engine, the exhaust gas system comprises a $NO_x$ reduction assembly.

Optionally, the control unit is adapted to receive a signal with a $NO_x$ value indicative of the $NO_x$ content in the exhaust gas from a $NO_x$ sensor being located in a position between, as seen in an intended direction of exhaust gas flow, the engine and the $NO_x$ reduction assembly in the exhaust gas system.

Optionally, the control unit is adapted to receive a signal with a $NO_x$ value indicative of the $NO_x$ content in the exhaust gas from a $NO_x$ sensor being located in a position downstream, as seen in an intended direction of exhaust gas flow, of the $NO_x$ reduction assembly in the exhaust gas system.

Optionally, the control unit is adapted to receive a signal indicative of the geographical location of the ship, the control unit further being adapted to determine the $NO_x$ threshold value on the basis of the thus determined geographical location.

Optionally, the control unit is adapted to issue a control signal to increase the engine speed of the engine upon detection that the $NO_x$ value exceeds the $NO_x$ threshold value.

A sixth aspect of the present invention relates to a control unit for controlling the propulsion of a ship. The ship comprises an engine and a controllable pitch propeller. The engine comprises at least one cylinder. The control unit is adapted to receive a signal indicative of an output set point value. The control unit is also adapted to issue control signals to control the engine speed of the engine and the propeller pitch of the controllable pitch propeller in response to the output set point value. The control signals are determined such that the ship is operated in an operating condition, corresponding to the output set point value, with an engine speed of the engine and a propeller pitch of the controllable pitch propeller such that the fuel consumption of the ship is brought and/or held within a desired fuel consumption range.

According to the sixth aspect of the present invention, the control unit is adapted to:

receive a top pressure signal with a top pressure value indicative of a top pressure in the at least one cylinder and to issue a control signal to reduce the torque of the engine upon detection that the top pressure value exceeds a top pressure threshold value.

Optionally, the control unit is adapted to issue a control signal to increase the engine speed of the engine upon detection that the top pressure value exceeds the top pressure threshold value.

Optionally, the control unit is adapted to issue a control signal to reduce the propeller pitch of the controllable pitch propeller in order to reduce the torque of the engine.

A seventh aspect of the present invention relates to a ship comprising a control unit according to the fifth or sixth aspect of the present invention.

BRIEF DESCRIPTION OF THE DRAWINGS

With reference to the appended drawings, below follows a more detailed description of embodiments of the invention cited as examples.

In the drawings.

DETAILED DESCRIPTION OF PREFERRED EMBODIMENTS

Figure 4:
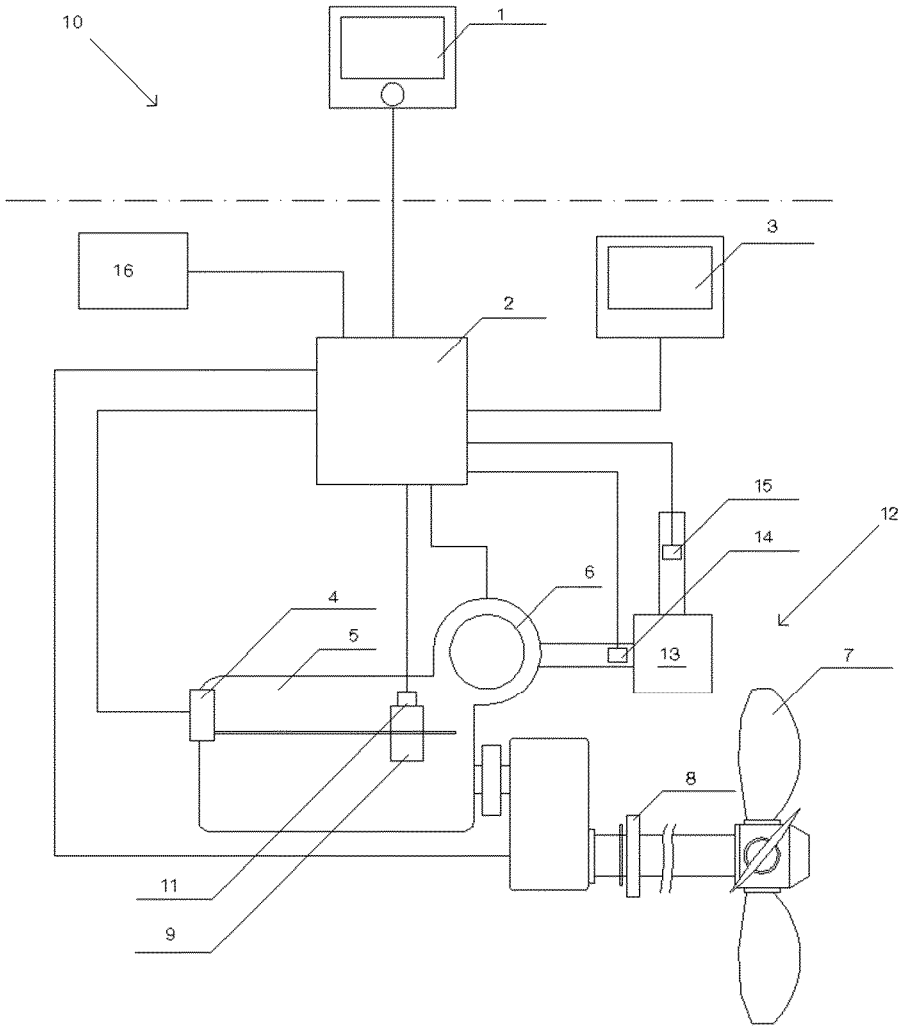
FIG. 4 is block diagram of an embodiment of a ship.

FIG. 4 illustrates an embodiment of a ship 10. The FIG. 4 ship comprises an engine 5, which may also be referred to as a main engine, and a controllable pitch propeller 7. The torque and engine speed may be adjusted to correspond to an output set point value, e.g. a desired or target engine power output value. Purely by way of example, the output set point value may be set using on-board or remotely located user board 1 illustrated in FIG. 4. Generally, the output set point value is indicative of a desired power produced by the engine 5 and the controllable pitch propeller 7.

Purely by way of example, and as indicated in FIG. 4, a signal indicative of the output set point value may be sent from the user board 1 to an on-board or remotely located control unit 2. As a non-limiting example, the control unit 2 may receive information from the engine 5, an engine speed regulator 4, a turbo assembly 6, the controllable pitch propeller 7 and possibly a shaft output sensor 8. Furthermore, though again purely by way of example, the ship 10 may comprise an additional user board 3 for setup of the system and data reading.

Moreover, the control unit 2 may be adapted to issue control signals to the engine 5 and the propeller 7 or a propeller regulating arrangement (not show) to thereby control the engine speed of the engine 5 and the propeller pitch of the controllable pitch propeller 7. By controlling the propeller pitch, the torque of the engine 5 may be controlled.

Additionally, the FIG. 4 embodiment of the ship 10 comprises a cylinder set comprising least one cylinder 9. Moreover, in FIG. 4, the embodiment of the ship 10 disclosed therein comprises a cylinder pressure sensor 11 adapted to determine the pressure in the at least one cylinder 9. By way of example, the cylinder pressure sensor 11 may be adapted to determine top pressure in at least one of the cylinders.

FIG. 4 also illustrates that the embodiment of the ship 10 illustrated therein comprises an exhaust gas system 12 adapted to guide exhaust gas from the engine 5. Moreover, as indicated in FIG. 4, the exhaust gas system 12 may comprise a $NO_x$ reduction assembly 13. Purely by way of example, such a $NO_x$ reduction assembly may comprise a catalyst adapted to reduce the $NO_x$ content in the exhaust gases.

Further, FIG. 4 illustrates that the ship 10 may comprise an upstream $NO_x$ sensor 14 located between, as seen in an intended direction of exhaust gas flow, the engine 5 and the $NO_x$ reduction assembly 13. Instead of, or in addition to the upstream $NO_x$ sensor 14, the ship may comprise a downstream $NO_x$ sensor 15 located downstream, as seen in an intended direction of exhaust gas flow, of the $NO_x$ reduction assembly 15 in the exhaust gas system 12.

Furthermore, the FIG. 4 ship 10 comprises a position sensor 16, which for instance may comprise a global positioning system, adapted to determine the geographical location of the ship 10.

Although the FIG. 4 embodiment of the ship 10 comprises each one of the cylinder pressure sensor 11, the upstream $NO_x$ sensor 14, the downstream $NO_x$ sensor 15 and the position sensor 16, it is envisaged that other embodiments of the ship 10 may comprise only one of the above sensors 11, 14, 15, 16. Further, embodiments of the ship 10 are envisaged comprising two or more of the sensors 11, 14, 15, 16.

Figure 1:
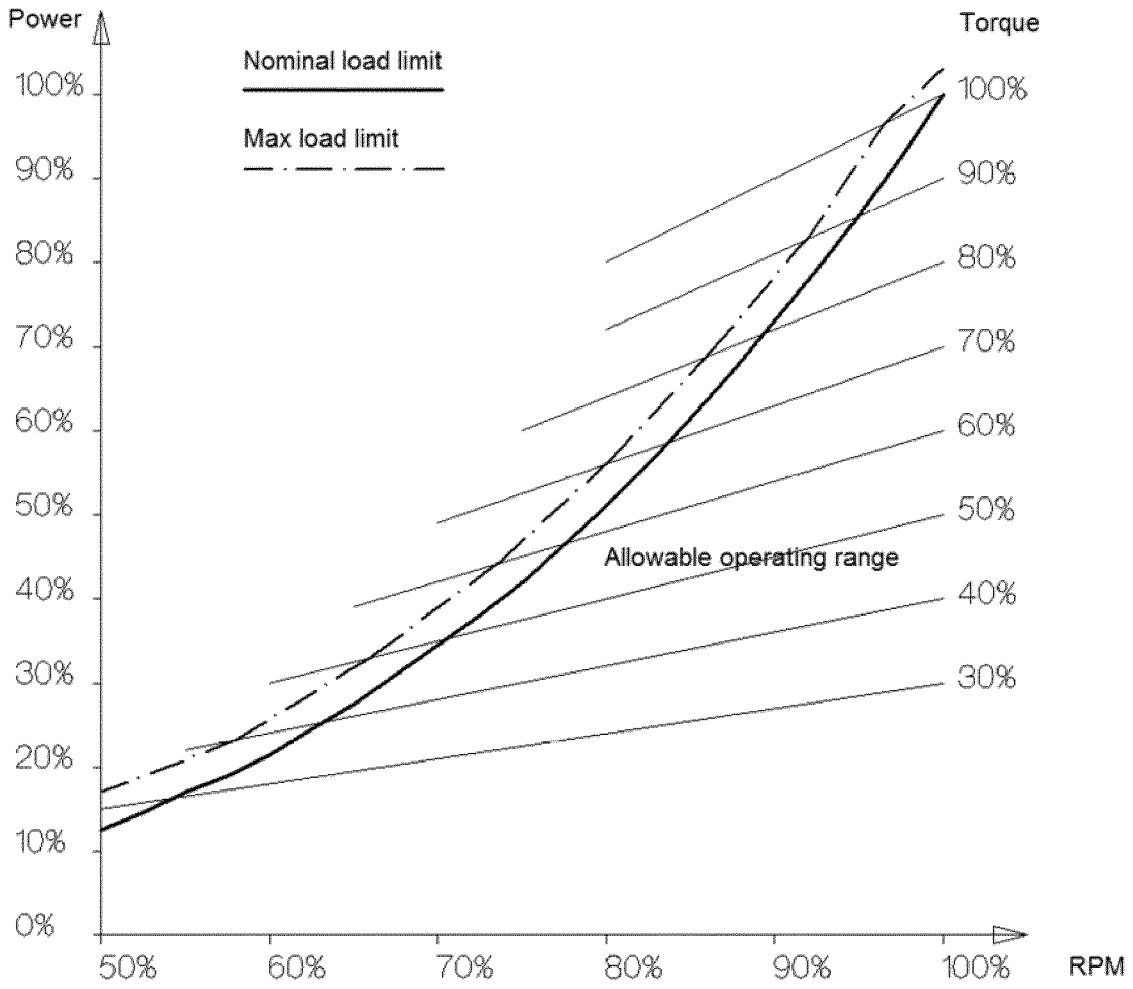
FIG. 1 illustrates a typical load limit curve for an engine.

FIG. 1 illustrates a load limit curve for an engine, for instance the FIG. 4 engine 5. As may be gleaned from FIG. 1, the graph illustrated therein presents the engine speed (presented as a percentage of maximum engine speed) on the abscissa and the power on the ordinate. Moreover, FIG. 1 includes isolines for different torque levels (also presented as percentage of the maximum torque producible by the engine). As may be realized from FIG. 1, the power produced by the engine increases as the torque increases. In a similar vein, the power produced by the engine increases as the engine speed increases.

Moreover, as may be realized from FIG. 1, a certain power level may be obtained by a plurality of different combinations of engine torque and engine speed. Generally, from a fuel consumption point of view, it is beneficial to operate the engine at a high torque level.

Figure 2:
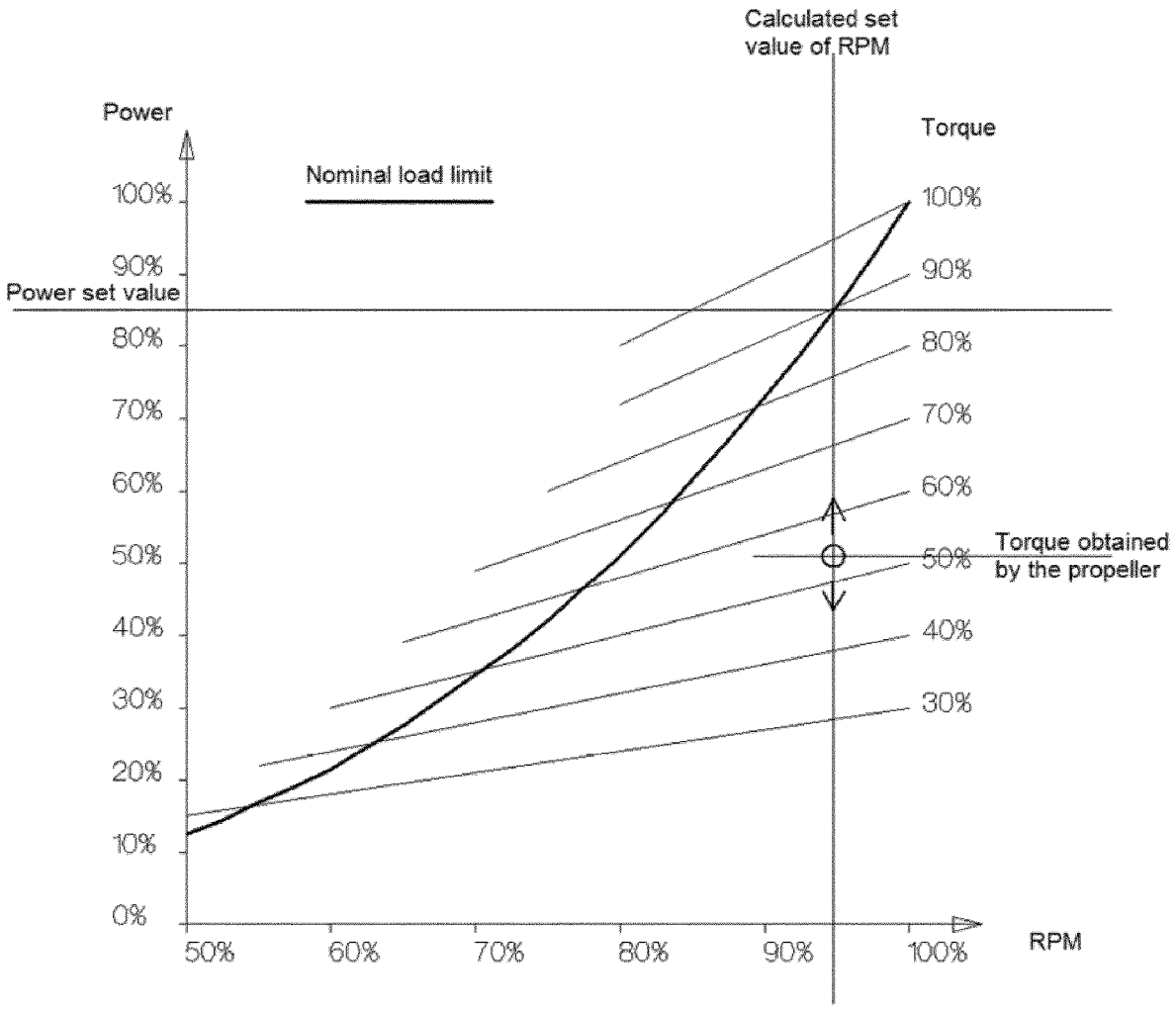
FIG. 2 illustrates a calculation of an output set value for engine speed and control of torque in order to obtain the correct requested effect.

As such, and with reference to FIG. 2, upon receipt of an output set point value, for instance indicative of the power produced by the engine, the engine is preferably operated at a condition with a high torque level, for instance at the highest torque level possible in view of the engine's load limit, and the engine speed is controlled such that the combination of engine speed and engine torque corresponds to the requested power, or the output set point value.

However, the present invention proposes also taking additional parameters into account when determining a suitable combination of engine torque and engine speed in order to meet the requested power, or the output set point value.

As such, a first aspect of the present invention relates to a method for controlling the propulsion of a ship 10. The ship 10 comprises an engine 5 and a controllable pitch propeller 7, wherein torque and engine speed are adjusted to correspond to an output set point value. As has been intimated hereinabove, the torque of the engine may be controlled by controlling the propeller pitch of the controllable pitch propeller 7.

The adjustment of the torque and engine speed is such that the ship 10 is operated in an operating condition with an engine speed of the engine 5 and a propeller pitch of the controllable pitch propeller 7 such that the fuel consumption of the ship is brought and/or held within a desired fuel consumption range. As such, with reference to FIG. 2, the engine speed and the propeller pitch are generally controlled such that the engine torque is as high as possible in view of the engine's load limit curve and also in view of further boundary conditions, as will be elaborated on hereinbelow.

According to the first aspect of the present invention, the method comprises:

determining a NO value indicative of a NO content in the exhaust gas produced by the engine 5 and reducing the torque of the engine 5 upon detection that the $NO_x$ value exceeds a $NO_x$ threshold value.

As such, the above-mentioned $NO_x$ value may be a boundary condition to be used when determining a combination of engine speed and engine torque corresponding to the output set point value and also which results in a fuel consumption within a desired fuel consumption range.

The $NO_x$ value may be determined in a plurality of different positions. For instance, with reference to FIG. 4, the $NO_x$ value may be determined by evaluating exhaust gas between, as seen in an intended direction of exhaust gas flow, the engine 5 and the $NO_x$ reduction assembly 13 in the exhaust gas system 12. As such, the $NO_x$ value may be determined using the upstream $NO_x$ sensor 14 in FIG. 4.

Instead of, or in addition to determining the NO value in the above position, the method may comprise determining the NO value by evaluating exhaust gas downstream, as seen in an intended direction of exhaust gas flow, of the $NO_x$ reduction assembly 13 in the exhaust gas system 12. As such, the $NO_x$ value may be determined using the downstream $NO_x$ sensor 15 in FIG. 4.

The $NO_x$ threshold value need not necessarily be constant. Instead, the $NO_x$ threshold value may vary, for instance in dependence on the geographical location of the ship 10. As such, the method may comprise determining the geographical location of the ship 10, for instance using a position sensor 16 and determining the $NO_x$ threshold value on the basis of the thus determined geographical location. Purely by way of example, the control unit 2 may comprise a look-up table with different $NO_x$ threshold values for different geographical locations.

Moreover, the method may also comprise a feature that the engine speed of the engine 5 is increased upon detection that the $NO_x$ value exceeds the $NO_x$ threshold value.

Instead of, or in addition to, using the $NO_x$ value may as a boundary condition when determining a set of engine speed and engine torque that corresponds to the output set point value and which also results in a fuel consumption within a desired fuel consumption range, a top pressure value may be used as a boundary condition.

As such, a second aspect of the present invention relates to a method for controlling the propulsion of a ship wherein the method comprises determining a top pressure value indicative of a top pressure in at least one cylinder 9 (see FIG. 4). Purely by way of example, the top pressure value may be determined using a cylinder pressure sensor, such as the cylinder pressure sensor 11 presented hereinabove in relation to FIG. 4. Moreover, the method according to the second aspect of the present invention comprises reducing the torque of the engine 5 upon detection that the top pressure value exceeds a top pressure threshold value.

Purely by way of example, the top pressure threshold value may be determined in order to reduce the risk of excessive loads and/or excessive wear of the engine 5. However, instead of, or in addition to, the above, the top pressure threshold value may be determined such that for instance engine emissions are kept within desired ranges. Purely by way of example, a correlation between top pressures and $NO_x$ emissions may be generated and a top pressure corresponding to a maximum desirable $NO_x$ emission level may be used as the top pressure threshold value.

In the event that an engine comprises a plurality of cylinders, the top pressure may be measured in one of the cylinders. Alternatively, the top pressure may be measured in two or more of the cylinders and the maximum top pressure measured in the one or more cylinders may be used as the top pressure value which consequently is compared to the top pressure threshold value.

Furthermore, as for the method according to the first aspect of the present invention, the engine speed of the engine 5 may be increased upon detection that the top pressure value exceeds the top pressure threshold value.

Irrespective of which boundary condition that is used when controlling the propulsion of the ship 10, the feature of reducing the torque of the engine 5 may comprises reducing the propeller pitch of the controllable pitch propeller 7.

Moreover, it should be noted that each one of the method embodiments presented hereinabove may be carried out by one or more control unit(s), such as the control unit 2 presented hereinabove in relation to FIG. 4. As such, the control unit 2 may be adapted to receive signals indicative an output set point value, for instance using the user board 1 illustrated in FIG. 4. Moreover, as has been intimated hereinabove, the control unit 2 may also be adapted to receive signals indicative of the engine speed of the engine 5 and the propeller pitch of the controllable pitch propeller 7. Further, the control unit 2 may also be adapted to receive signals indicative of the relevant boundary condition, e.g. the $NO_x$ value and/or the top pressure value, and to compare the thus received signal to a corresponding threshold value. Moreover, the control unit 2 may be adapted to issue control signals indicative of the engine speed of the engine and the propeller pitch of the controllable pitch propeller in response to the output set point value, taking the above boundary condition into account.

As such, the control unit 2 of the ship 10 may be adapted to perform the procedure of any one of the methods presented hereinabove.

Figure 3:
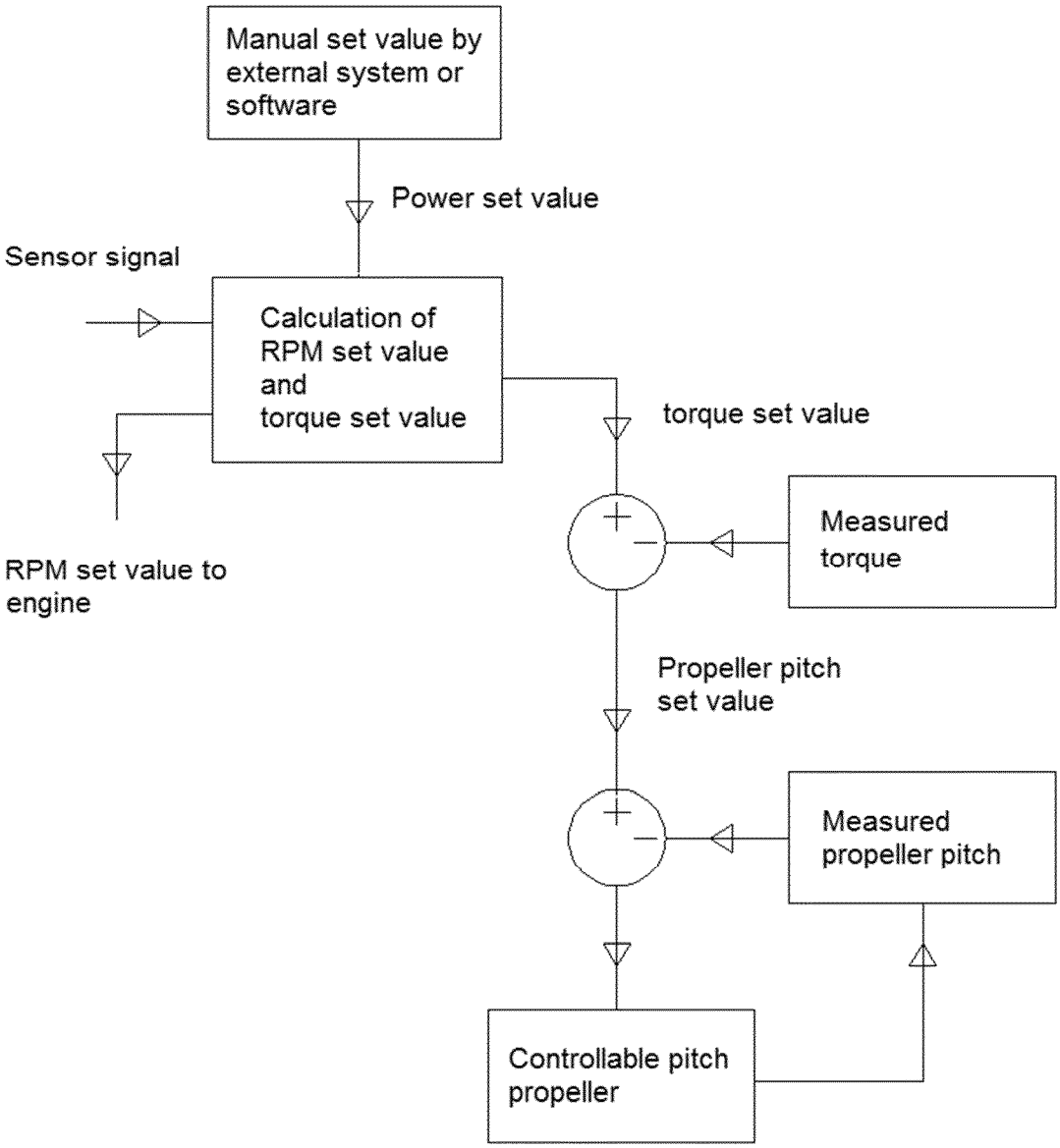
FIG. 3 is diagram of an example control logic.

FIG. 3 illustrates an example of a control logic for a control unit 2. As may be gleaned from FIG. 3, the control logic may comprise a regulator for controlling the engine speed of the engine and the propeller pitch of the controllable pitch propeller. The FIG. 3 control logic may also comprise means for taking one or more of the above discussed boundary conditions into account when controlling the engine speed and the propeller pitch. As such, the regulator may be adapted to receive sensor signals, such as signals from at least one of the previously discussed cylinder pressure sensor 11, the upstream NOx sensor 14 and the downstream NOx sensor 15, and use information in the signals when determining set values for engine speed and torque, i.e. the propeller pitch of the controllable pitch propeller.

The invention claimed is:

1. A method for controlling the propulsion of a ship by a control unit, said ship comprising an engine and a controllable pitch propeller, said engine comprising at least one cylinder, wherein torque and engine speed are adjusted to correspond to an output set point value, wherein the adjustment is such that said ship is operated in an operating condition with an engine speed of said engine and a propeller pitch of said controllable pitch propeller such that the fuel consumption of said ship is brought and/or held within a desired fuel consumption range, the method comprising:

determining a top pressure value indicative of a top pressure in said at least one cylinder; and reducing the torque of said engine upon detection that the top pressure value exceeds a top pressure threshold value.

2. The method according to claim 1, wherein the engine speed of said engine is increased upon detection that the top pressure value exceeds said top pressure threshold value.

3. The method according to claim 1, wherein said feature of reducing the torque of said engine comprises reducing the propeller pitch of said controllable pitch propeller.

4. A computer program comprising program code for performing the steps of claim 1 when the computer program is run on a computer.

5. A computer readable medium carrying a computer program comprising program code for performing the steps of claim 1 when the computer program is run on a computer.

6. A control unit for controlling the propulsion of a ship, said ship comprising an engine and a controllable pitch propeller, said engine comprising at least one cylinder, wherein said control unit is adapted to receive a signal indicative of an output set point value, said control unit also being adapted to issue control signals to control the engine speed of said engine and the propeller pitch of said controllable pitch propeller in response to said output set point value, wherein the control signals are determined such that said ship is operated in an operating condition, corresponding to said output set point value, with an engine speed of said engine and a propeller pitch of the controllable pitch propeller such that the fuel consumption of said ship is brought and/or held within a desired fuel consumption range, said control unit further being adapted to:

receive a top pressure signal with a top pressure value indicative of a top pressure in said at least one cylinder; and to issue a control signal to reduce the torque of said engine upon detection that said top pressure value exceeds a top pressure threshold value.

7. The control unit according to claim 6, wherein said control unit is adapted to issue a control signal to increase said engine speed of said engine upon detection that said top pressure value exceeds said top pressure threshold value.

8. The control unit according to claim 6, wherein said control unit is adapted to issue a control signal to reduce the propeller pitch of said controllable pitch propeller in order to reduce the torque of said engine.

9. A ship comprising a control unit according to claim 6.

* * * * *